US006007397A

United States Patent [19]

Ju et al.

[11] Patent Number: 6,007,397

[45] Date of Patent: Dec. 28, 1999

[54] VACUUM PACKAGING APPARATUS FOR A FIELD EMISSION DISPLAY AND A METHOD THEREOF USING A GLASS-TO-GLASS BONDING

[75] Inventors: Byeong Kwon Ju, Seoul; Woo Beom Choi, Koyang; Myung Hwan Oh, Seoul, all of Rep. of Korea

[73] Assignee: Korea Institute of Science and Technology, Rep. of Korea

[21] Appl. No.: 09/103,741

[22] Filed: Jun. 24, 1998

[30] Foreign Application Priority Data

Dec. 26, 1997 [KR] Rep. of Korea ..... 97/74807

[51] Int. Cl.[6] ..... H01J 9/40

[52] U.S. Cl. ..... 445/25; 445/70

[58] Field of Search ..... 445/25, 43, 70

[56] References Cited

U.S. PATENT DOCUMENTS 5,797,780 8/1998 Peng ..... 445/25

OTHER PUBLICATIONS

On the Anistropically Etched Bonding Interface of Directly Bonded (100) Silicon Wafer Pairs, B.K. Ju, et al, J. Electrochem, Soc., vol. 142, No. 2., Feb. 1995, pp. 547–553.

Field Assisted Glass–Metal Sealing, George Wallis and Daniel Pomerantz, Journal of Applied Physics, vol. 40, No. 10., Sep., 1969, pp. 3946–3949.

Assembling three–dimensional microstructures using gold–silicon eutectic bonding, A.–L. Tiensuu, et al, Sensors and Actuators A 45 (1994) pp. 227–236.

*Primary Examiner*—Kenneth J. Ramsey

*Attorney, Agent, or Firm*—Ostrolenk, Faber, Gerb & Soffen, LLP

[57] ABSTRACT

In the present invention, the vacuum packaging of a field emission display (FED) is achieved in a high vacuum apparatus using a glass-to-glass bonding. The apparatus may eliminate the problems encountered in the conventional art in which a ventilation tube is used, so that vacuum degree of the interior of panels of the FED is affected (decreased) by the gases generated in sealing the ventilation tube. Furthermore, in the prior art, a part of the ventilation tube remains on the panel of the FED for thereby increasing the thickness of the panels, and the ventilating of gases is not effectively performed by the extension of the tube and a big size hole. The vacuum packaging apparatus of the FED and method therefor according to the present invention are capable of more effectively packaging FED by implementing a glass-to-glass bonding by ventilating gases from the interior of the panel of the FED in a manner of a high temperature ventilation in a high vacuum apparatus, contacting a glass substrate piece with a hole formed in the panel of the FED and applying a DC voltage thereto. Therefore, it is possible to easily implement a vacuum packaging of the FED and vacuum degree of the interior of the FED panel may be increased.

11 Claims, 4 Drawing Sheets

VACUUM PACKAGING APPARATUS FOR A FIELD EMISSION DISPLAY AND A METHOD THEREOF USING A GLASS-TO-GLASS BONDING

BACKGROUND OF THE INVENTION

1. Field of the Invention

The present invention relates to a vacuum packing apparatus for a field emission display (FED) and a method thereof, in particular, to a tubeless vacuum packing for a FED using a glass-to-glass bonding in the high vacuum apparatus.

2. Description of the Prior Art

A cathode tube vacuum packaging method is a typical vacuum packaging technique for the FED. In this method, a gas existing in the interior of the FED is ventilated to the outside using a ventilation tube, and then the ventilation tube is cut to separate the FED from a pumping apparatus and then the cut ventilation tube is sealed. The above-described procedure is known as a sealing process. The sealing process is divided into two steps. In the first step, when the state the pump is operated, a predetermined portion of the ventilation tube is heated and made into a semi-melted state. In the second step, the ventilation tube is cut and then the cut ventilation tube is sealed for thereby maintaining a sealed state for the FED. When sealing the cut ventilation tube, since the ventilation tube is in a semi-melted state and then hardened, a predetermined amount of gases is generated during the above-described sealing procedure.

When vacuum packaging the FED using a ventilation tube according to the prior art, since the inner volume of the FED is relatively smaller compared to the cathode tube, the vacuum degree of the interior between the panels of the FED is significantly affected by the gases generated in sealing the ventilation tube, although the type of gas is not an important factor for the relatively large cathode tubes. In addition, the vacuum degree which is required for the interior of the FED should be more than $10^{-6}$ torr. However, the gases generated inside of the FED during vacuum packaging, in particular, when the ventilation tube is sealed may not be effectively ventilated, the vacuum degree of the interior of the FED is decreased. Furthermore, a part of the cut ventilation tube remains in the panel of the FED, so that the thickness of the panel increases. In addition, the ventilation operation of the gas may be affected by the extension of the ventilation tube.

SUMMARY OF THE INVENTION

Accordingly, it is an object of the present invention to provide a vacuum packaging apparatus of FED using a bonding between glass substrates and a method thereof which can overcome the aforementioned problems encountered in the background art.

It is another object of the present invention to provide a vacuum packaging apparatus of FED using a bonding between glass substrates and a method thereof which is capable of more effectively packaging a FED and enhancing the vacuum degree between the panels of the FED, thereby to provide a FED having good characteristics.

To achieve the above objects, there is provided a vacuum packaging apparatus for the FED using a glass-to-glass bonding process, which comprises:

a chamber;

a vacuum pump for generating a high vacuum state in the chamber;

a FED receiving means disposed in the chamber and including a FED heating means for heating the FED in which a ventilation hole is formed in one of a pair of glass panels and a FED retaining member for retaining the FED;

a glass substrate piece receiving means disposed in the chamber and being opposite to said FED receiving means, which comprising a glass substrate piece retaining member retaining the glass substrate piece to cover the ventilation hole, a retaining member driving means for driving said glass substrate piece retaining member toward and away from said FED receiving unit and a glass substrate piece heating means for heating the retaining member driving means and the glass substrate piece thereon;

a FED temperature control means connected with said FED heating means and the FED retaining member for measuring a temperature of the FED and controlling the FED to have a predetermined temperature using the FED heating means;

a glass substrate piece temperature control means connected with the glass substrate piece heating means and the glass substrate piece retaining member for measuring a temperature of the glass substrate piece and controlling the glass substrate piece to have a predetermined temperature using the glass substrate piece heating means; and, an electric power supply unit for supplying a DC voltage to the FED, in particular to the panel with ventilation hole(s) of the FED and glass substrate piece, with a positive electrode of the electric power supply unit being connected with the panel of the FED, a negative electrode of the electric power supply unit being connected with the glass substrate pieces which are to be bonded to the FED.

In this apparatus, the vacuum pump may comprise a rotary pump, a turbo pump or cryo pump, but not limited to those. In addition, the number of the ventilation hole may be 1 through 4.

In addition, in order to achieve the above objects, there is provided a vacuum packaging method for the FED using a glass-to-glass bonding, which comprising the steps of:

pre-forming a ventilation hole in one of a pair of glass panels of an FED;

forming an electrode metallic thin film surrounding the ventilation hole on the glass panel in which the ventilation hole is formed;

forming a silicon layer on the metallic thin film, which is used for a bonding;

disposing the glass substrate piece in the interior of the vacuum chamber for packaging the FED and the hole therein, ventilating the interior of the chamber to have a vacuum degree of $10^{-8}$~$3\times10^{-8}$ torr and ventilating gases from the interior of the panels of the FED and the glass substrate piece in a state of a high temperature in the range of 350~400° C.;

gradually decreasing a temperature of the FED and the glass substrate piece and maintaining a glass-to-glass bonding temperature at 250~300° C.;

contacting the glass substrate piece with the panel of the FED, with covering the hole in said panel; and, performing a glass-to-glass bonding by applying a DC voltage in the range of 200~400V between the panel of the FED and the glass substrate piece.

In these procedure, the step for forming the ventilation hole is accomplished by using directly a drill, or by using an arc. The method for forming a hole using an arc is achieved by put a glass substrate into a solution of KOH and positioning a needle-type electrode applied by about 10V of DC voltage close to the surface of the glass substrate, thereby producing an arc between the substrate and the solution of KOH and a hole being formed in the glass substrate.

In the vacuum packaging method of the FED according to the present invention, an electrode metallic thin film is formed on the back side of a cathode (panel) in which a ventilation hole is formed. A silicon layer is deposited on the metallic thin film. Thereafter, gases are ventilated from the interior of the panel of the FED in a manner of a high temperature ventilation in the high vacuum apparatus. The glass substrate pieces which are to be bonded is held against the silicon layer, and then a DC voltage is applied thereto, so that a junction is formed on a boundary surface between a silicon layer and a glass for thereby implementing a vacuum packaging of the FED.

The glass substrate is made from a material containing a metallic component having a large ionization tendency such as a natrium or a lithium. In explaining the mechanism of a glass-to-glass bonding in detail, in the case that a silicon layer is contacted with a glass substrate, and then a predetermined temperature is applied thereto, the metallic components of the glass substrates are ionized and become an ion state having electrostatic charges. At this time, when a negative electrode and a positive electrode of DC voltage is externally applied to the glass substrate and the silicon layer, respectively, the ionized metallic ions of the glass substrate are moved to the cathode by the electric field formed at both ends of the silicon layer-glass substrate, and the electrons in the silicon layer are moved to the anode, thereby a spacious electric charge region is formed in the boundary surface between the silicon layer-glass substrate. Therefore, a strong electrostatic force is generated by the above-described spacious electric charge. Then, the oxygen atoms of the glass substrate are forcibly moved to the glass surface and are engaged with silicon atoms to form a Si—O atomic coupling, so that a bonding between the silicon and the glass substrate is achieved.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PRESENT INVENTION

A vacuum packaging apparatus for a FED using a glass-to-glass bonding and a method thereof according to the present invention will now be explained with reference to the accompanying drawings.

Figure 1:
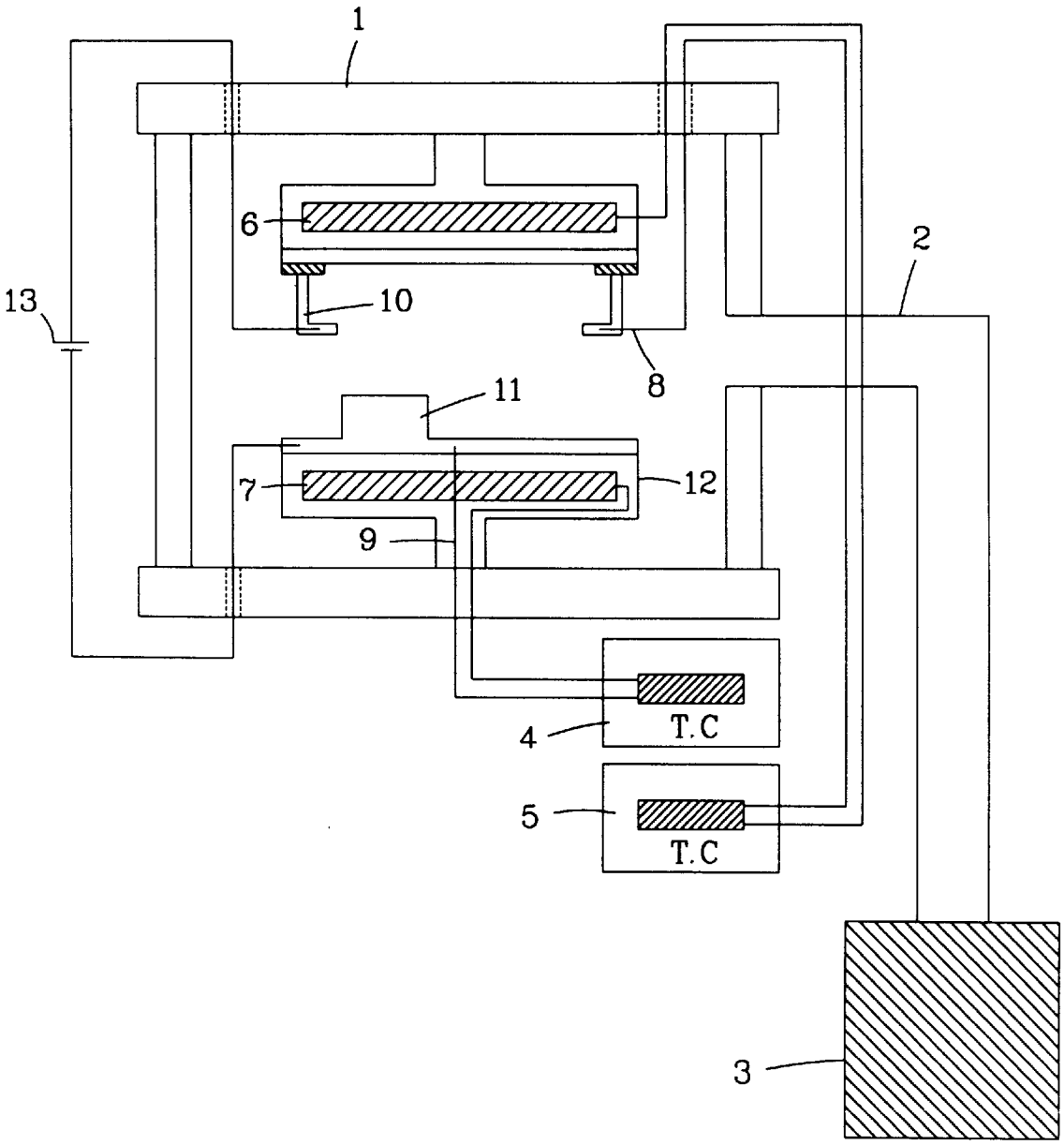
FIG. 1 illustrate the construction of a high vacuum apparatus for a vacuum packaging of the FED using a glass-to-glass bonding according to the present invention.

An example of the vacuum packaging apparatus for the FED according to the present invention is shown in FIG. 1.

As shown therein, the vacuum packaging apparatus for the FED includes a vacuum chamber 1 maintaining a predetermined vacuum degree therein, a vacuum pump 3 for implementing a high vacuum ventilation, such as a rotary pump, a turbo pump or a cryo pump, a connection tube 2 connecting the chamber 1 with the vacuum pump 3, heating apparatuses 6, 7 for heating the panel 14 of a FED and a glass substrate piece 17 bonded thereto simultaneously with a high temperature ventilation process, temperature sensors 8, 9 for sensing the temperature of the panel 14 of the FED and the glass substrate piece respectively, temperature control device 4, 5 for applying an appropriate electric power to said heating apparatus to control the temperature of the panel 14 and the glass substrate piece 17 based on the measured temperature from said sensors, and a DC voltage supply apparatus 13 for applying a DC voltage to the panel 14 of the FED and the glass substrate piece 17 bonded thereto.

In addition, the vacuum packaging apparatus described above further comprises a FED retaining member 10 for holding the FED. In detail, the panel 14 has a ventilation hole therein, a glass substrate piece retaining member 11 for mounting the glass substrate piece 17 to be bonded to the panel, and a drive support member 12 for upwardly and downwardly moving the glass substrate piece retaining member 11.

Next, the method for vacuum packaging a FED using the above-described apparatus will now be explained with reference to FIGS. 2A and 2B.

Figure 2A:
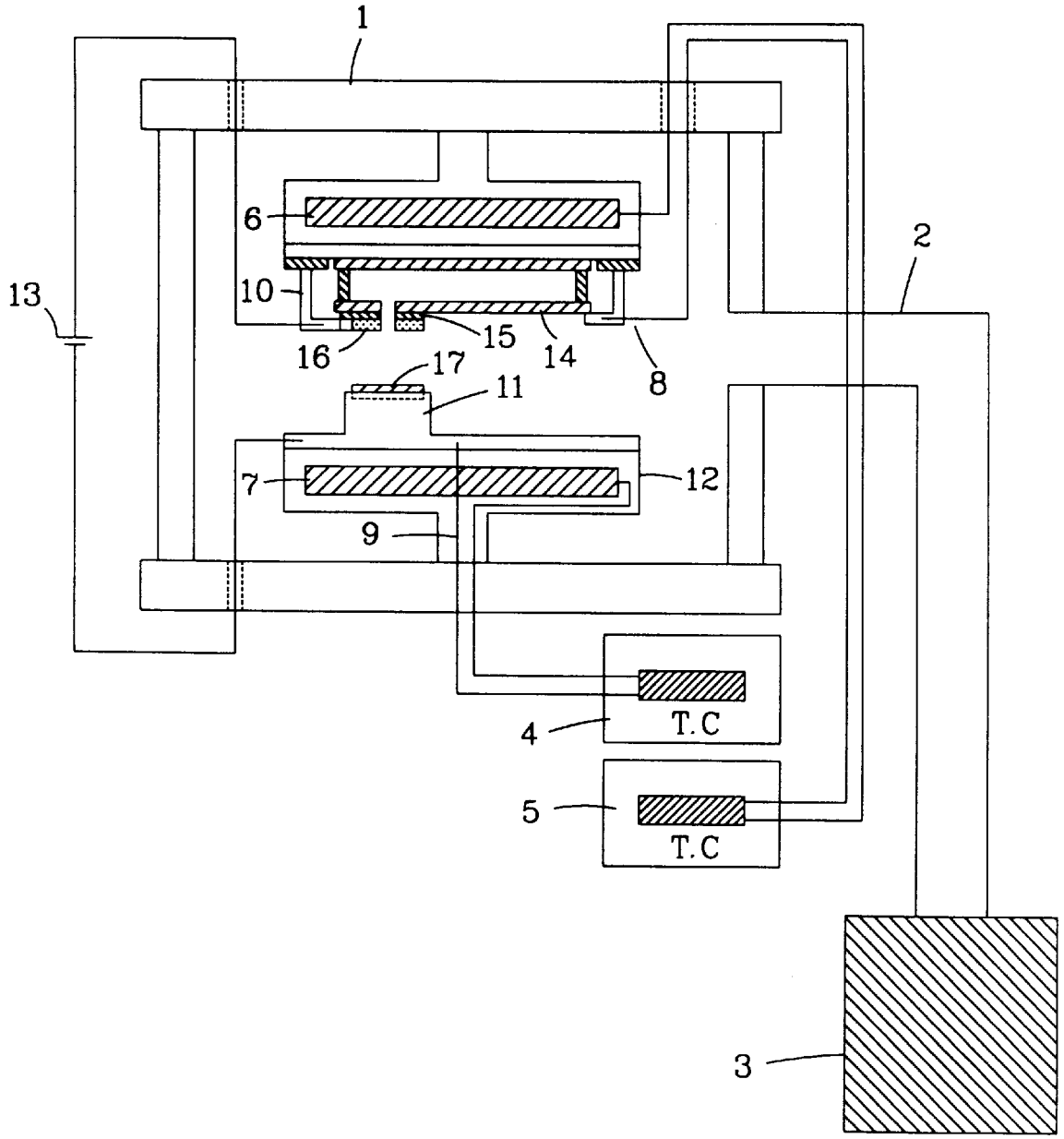
FIGS. 2A and 2B illustrate the bonding process for implementing the vacuum packaging of the FED according to the present invention; and, FIG. 3 shows a vacuum-packaged FED fabricated by a high vacuum apparatus for vacuum-packaging a FED using a glass-to-glass bonding according to the present invention.

As shown in FIG. 2A, the FED is mounted on the FED retaining member 10, wherein in the FED, an electrode metallic thin film 15 being formed on the back side of the cathode (panel) having a ventilation hole, and surrounding the hole, and a silicon layer 16 relating to a bondage being deposited on the metallic thin film 15. Furthermore, the glass substrate piece 17 for closing (or sealing) the ventilation hole is mounted on the glass substrate piece retaining member 11. After ventilating the vacuum chamber 1 with the vacuum pump 3 so that the interior of the vacuum chamber 1 has a vacuum degree of $10^{-8}$~$3\times10^{-8}$ torr. Thereafter, the gases are ventilated from the interior of the panel of the FED in a manner of a high temperature ventilation at a temperature of 350° C.~400° C. using the heating apparatuses 6 and 7.

Figure 2B:
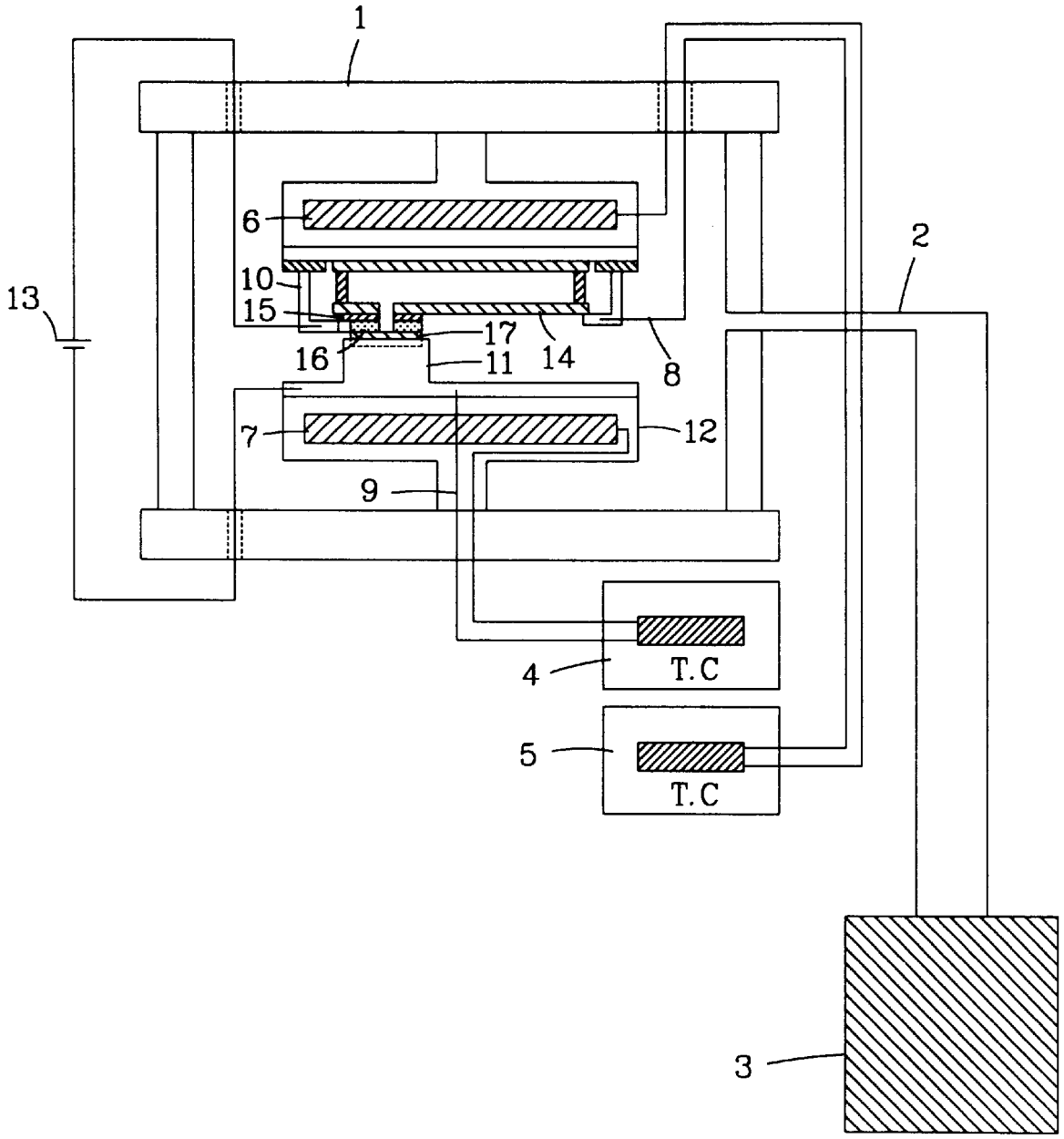

Next, as shown in FIG. 2B, decreasing the temperature by means of the temperature control devices 4 and 5, and maintaining the temperature of the glass-to-glass bonding at 250° C.~300° C., the glass substrate piece retaining member 11 is upwardly moved using the drive support member 12 which is upwardly and downwardly movable, so that the glass substrate piece 17 contacts with the panel of the FED with covering the hole therein. Then, DC voltage of 200~400 volts is applied thereto using the DC voltage supply apparatus 13, with connecting the negative electrode of the DC voltage supply apparatus 13 to the glass substrate piece 17 and the positive electrode of the same to the electrode metallic thin film 15 in the panel 14 of the FED, so that the boundary surface between the glass substrate piece and the (glass) panel of the FED is bonded by the above-described Si—O atomic coupling for thereby implementing a vacuum packaging of the FED.

Figure 3:
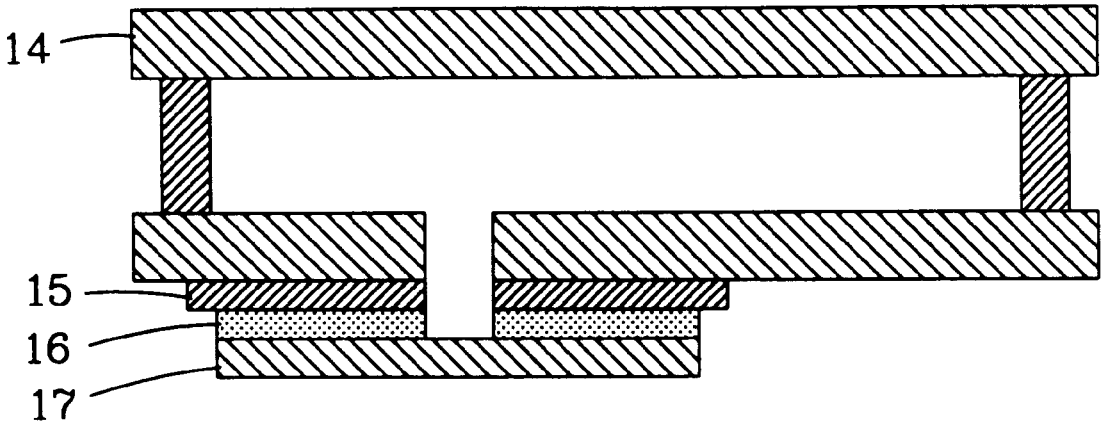

FIG. 3 illustrates the FED fabricated by a vacuum packaging method using a high vacuum packaging apparatus according to the present invention, which is based on a glass-to-glass bonding. The invention implements an effective ventilation of gases and packing process compared to the conventional art, thereby provides a FED having good features.

As described above, in the present invention, since the apparatus and method for vacuum packaging the FED in a high vacuum apparatus is accomplished using a glass-to-glass bonding, the following advantages are obtained. First, a ventilation tube is not used, thereby a ventilation conductance which is an important factor for a ventilation operation is enhanced, and thus, the time required for a ventilation of gases can be decreased. Second, since a vacuum packaging method is used in a solid state, the vacuum degree of the FED can be increased compared to that by the conventional art in which the vacuum degree is decreased by 10 through 100 times due to the gas which is generated when sealing the ventilation tube in the vacuum packaging process of the FED. Third, a FED must include a getter in the panel in order to maintain interior vacuum above a predetermined vacuum degree, and thus the additional procedure, such as forming a further hole in the panel for mounting the getter there into is needed in the vacuum packaging in the prior arts. In the present invention, however, the above-mentioned additional procedure may be eliminated, thereby the process for vacuum packaging of the FED may be simplified, since the getter may be pre-mounted on the glass substrate piece to be bonded to the panel of the FED, and then the vacuum packaging is proceeded.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A vacuum packaging apparatus for a field emission display (FED) comprising:

a chamber;

a vacuum pump for generating a high vacuum state in the chamber;

a FED receiving means disposed in the chamber and including a FED heating means for heating the FED in which a ventilation hole is formed in one of a pair of glass panels and a FED retaining member for retaining the FED;

a glass substrate piece receiving means disposed opposite to said FED receiving means in the chamber, which comprises a glass substrate piece retaining member for retaining the glass substrate piece to be engaged with the ventilation hole, a retaining member driving means for driving said glass substrate piece retaining member toward or away from said FED receiving means and a glass substrate piece heating means for heating the glass substrate piece on the glass substrate piece retaining member;

a FED temperature control means connected with said FED heating means and said FED retaining member for measuring a temperature of the FED and controlling the FED to have a predetermined temperature using the FED heating means;

a glass substrate piece temperature control means connected with the glass substrate piece heating means and the glass substrate piece retaining member for measuring a temperature of the glass substrate piece and controlling the glass substrate piece to have a predetermined temperature using the glass substrate piece heating means; and, an electric power supply unit for supplying a DC voltage to the FED and glass substrate piece, with a positive electrode of the electric power supply unit being connected with the FED, and a negative electrode of the electric power supply unit being connected with the glass substrate pieces which are to be bonded to the panel of the FED.

2. The apparatus of claim 1, further comprising a first sensor attached to the FED retaining member for measuring a temperature of the FED, and a second sensor attached to the glass substrate piece retaining member for measuring a temperature of the glass substrate piece.

3. A vacuum packaging method for a FED comprising the steps of:

pre-forming a ventilation hole in one of a pair of glass panels of an FED;

forming an electrode metallic thin film surrounding the ventilation hole on the glass panel in which the ventilation hole is formed;

forming a silicon layer on the metallic thin film, which is used for a glass-to-glass bonding;

disposing the glass substrate piece in an interior of a vacuum chamber for packaging the FED and the hole in the panel of the FED, ventilating the interior of the chamber to have a vacuum degree of $10^{-8}$~$3\times10^{-8}$ torr and ventilating gases from the interior of the panels of the FED and the glass substrate piece in a state of a high temperature in a range of 350~400° C.;

gradually decreasing the temperature of the FED and the glass substrate piece and maintaining a glass-to-glass bonding temperature at 250~300° C.;

contacting the glass substrate piece with the panel of the FED and covering the hole therein; and, performing a glass-to-glass bonding by applying a DC voltage in a range of 200~400V between the panel of the FED and the glass substrate piece.

4. The method of claim 3, wherein said ventilation hole is formed by one selected from a method using a drill and a method using an arc.

5. The method of claim 3 or 4, wherein the ventilation hole comprises 1 through 4 holes.

6. The method of claim 3, wherein said FED and glass substrate piece are disposed in the chamber in a manner of fixing the FED and the glass substrate piece to the FED retaining member and the glass substrate piece retaining member, respectively.

7. The method of claim 3, wherein a positive (+) electrode of the DC voltage is applied to the electrode metallic thin film on the panel of the FED using the FED retaining member and a negative (−) electrode is applied to the glass substrate piece using the glass substrate piece retaining member.

8. The method of claim 3, wherein the temperatures of the panel of the FED and the glass substrate piece are measured by temperature sensors which are disposed on the FED retaining member and the glass substrate piece retaining member, respectively, and the temperatures of the FED and the glass substrate piece are controlled by the temperature control means and heating means thereof.

9. The method of claim 3, wherein the temperatures of the panel of the FED and the glass substrate piece are maintained to be identical to each other during a glass-to-glass bonding operation.

10. The method of claim 3, wherein said vacuum pump is one selected from the group comprising a rotary pump, a turbo pump, and a cryo pump.

11. The method of claim 3, wherein said the glass substrate piece retaining member driving means is driven toward the FED, so that the glass substrate piece held on the glass substrate piece retaining member contacts with the ventilation hole in the panel of the FED.

* * * * *